United States Patent [19]

Goodlaxson

[11] 4,102,544

[45] Jul. 25, 1978

[54] RETAINING RING ASSEMBLY FOR FAUCET COUPLER

[75] Inventor: John D. Goodlaxson, Colfax, Iowa

[73] Assignee: The Maytag Company, Newton, Iowa

[21] Appl. No.: 660,321

[22] Filed: Feb. 23, 1976

[51] Int. Cl.[2] ..... E03C 1/00; F16L 55/00

[52] U.S. Cl. ..... 285/8; 137/562; 285/242; 285/316

[58] Field of Search ..... 285/1, 8, 242, 277, 285/308, 316, 321, DIG. 23, 314; 137/562

[56] References Cited

U.S. PATENT DOCUMENTS

| | | | |
|---|---|---|---|
| 2,788,243 | 4/1957 | Goodliffe et al. | 285/314 X |
| 3,011,725 | 12/1961 | Shames et al. | 137/562 X |
| 3,036,595 | 5/1962 | Rogers | 137/562 X |
| 3,444,890 | 5/1969 | Ralston | 137/562 |
| 3,529,775 | 9/1970 | Eckerle | 137/562 X |
| 3,559,681 | 2/1971 | Jarvis et al. | 285/8 X |
| 3,593,743 | 7/1971 | Guth | 137/562 |
| 3,630,227 | 12/1971 | Race | 137/562 |
| 3,635,243 | 1/1972 | Brezosky | 137/562 X |
| 3,692,053 | 9/1972 | Kaldenberg | 137/562 X |
| 3,761,117 | 9/1973 | Shendure | 285/277 |

*Primary Examiner*—Werner H. Schroeder
*Assistant Examiner*—Moshe I. Cohen
*Attorney, Agent, or Firm*—Richard L. Ward

[57] ABSTRACT

A coupler assembly for a portable washing machine which includes an improved method of assembling and retaining the faucet locking means between the coupler body and the retaining ring. The coupler body supports locking means in pockets between the retaining ring and the body. The retaining ring includes a plurality of inwardly extending segmental shoulders which define recesses therebetween. The retaining ring is assembled onto the coupler body by aligning the recesses with the locking means and sliding the ring onto the body. The retaining ring is then locked by rotating the ring to snap a leg portion into a detent slot in the body. The locking rotation moves the segmental shoulders into alignment with the locking means to prevent movement of the ring from the coupler body.

12 Claims, 10 Drawing Figures

RETAINING RING ASSEMBLY FOR FAUCET COUPLER

BACKGROUND OF THE INVENTION

1. Field of the Invention

This invention relates generally to faucet couplers for portable washing machines and more particularly to an improved coupler and method of assembling the coupler.

2. Description of the Prior Art

Prior coupler art shows coupler assemblies having molded plastic housings with metal faucet coupler parts. These assemblies generally have metal retaining rings to retain faucet locking means in the metal coupler body and the retaining rings in turn are retained on the coupler body by "snap" ring devices. Prior coupler assemblies thus required more parts in addition to the basic coupler pieces to facilitate assembly. Thus it is believed that there remains a need for a faucet coupler which incorporates improved means and method for assembling and locking the retaining ring to the coupler body.

SUMMARY OF THE INVENTION

It is therefore an object of this invention to provide an improved coupler assembly for a washing machine.

It is a further object of this invention to provide a simplified means of assembling a coupler to retain the locking means in the coupler assembly.

It is a further object of this invention to provide a retaining ring which can be assembled and locked onto a coupler body with a quarter turn motion to retain the faucet locking means between the ring and the body.

The instant invention achieves these objects in a coupler assembly having a coupler body for mounting faucet locking means and a retaining ring which is assembled onto the coupler body wherein a shoulder segment of the retaining ring is alignable with the locking means to prevent axial movement of the ring away from the coupler body when a portion of the ring is interlocked with the coupler body.

BRIEF DESCRIPTION OF THE DRAWINGS

The drawings illustrate preferred embodiments of the invention with similar numerals referring to similar part throughout the several views, wherein.

DESCRIPTION OF A PREFERRED EMBODIMENT

Figure 1:
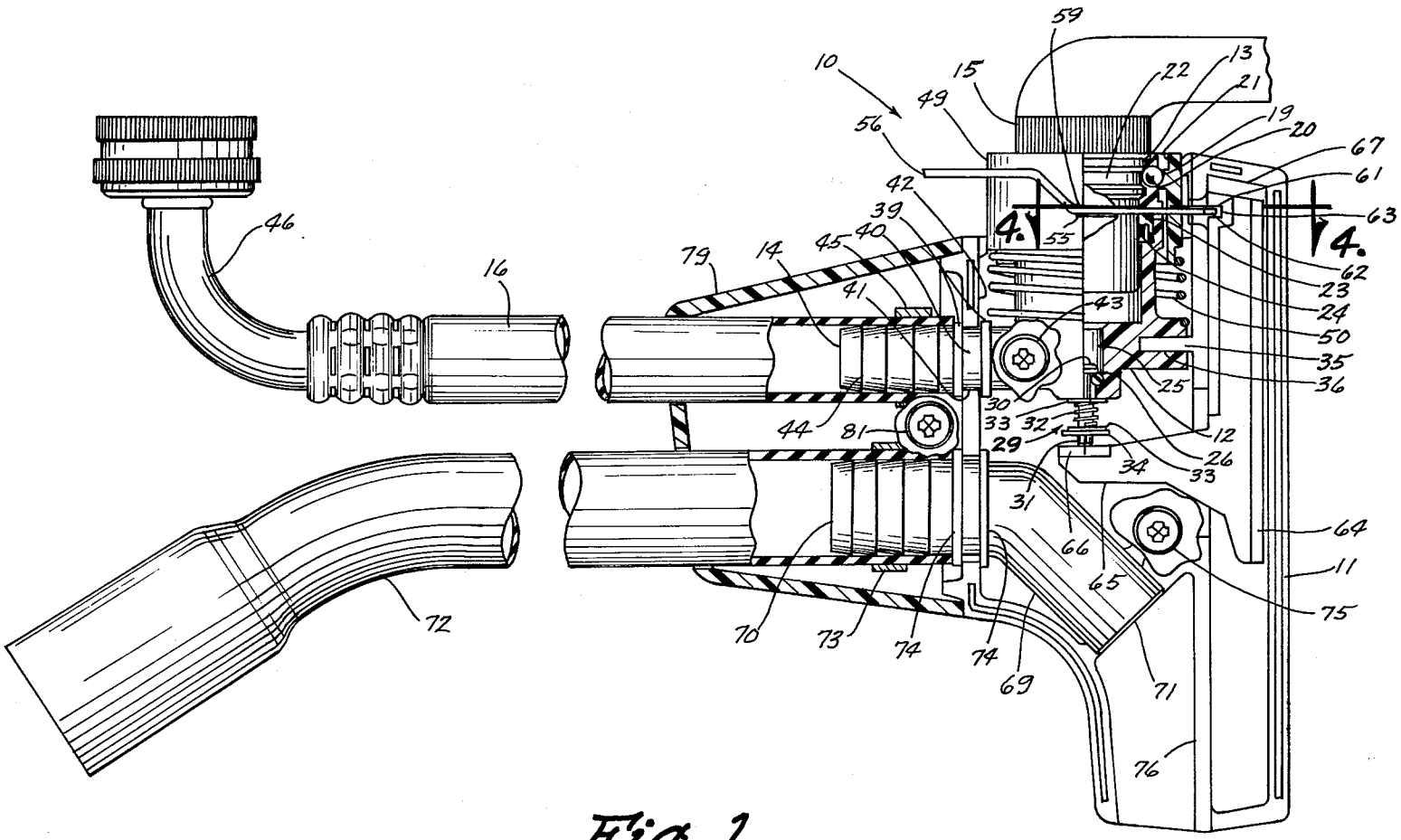
FIG. 1 is a view of a coupler assembly for a portable washer wherein the coupler assembly is partially broken away and sectioned and incorporates the instant invention.

Referring to FIG. 1 there is shown a coupler assembly 10 coupled to a faucet 15. A houding 11 having, in this embodiment, a plurality of communicating compartments or cavities contains and supports the various coupler components which will be described further herein.

As shown in FIG. 1 the coupler assembly 10 includes a coupler body 12 contained and supported within the housing 11. The coupler body 12 is molded of a thermoplastic material and is generally in the configuration of a right angled elbow. The body 12 has an inlet end 13 for coupling with a faucet 15 as shown in FIG. 1 and an outlet end 14 for receiving a rubber inlet hose 16 which conducts liquid to a washing machine.

The inlet end 13 also has a plurality of pockets 20 for receiving a plurality of locking balls 19. A first portion of each of the locking balls 19 is disposed between an inner diameter of a retaining ring 21 and the inlet end 13 of the coupler body 12. A second portion extends through the pocket 20 in the coupler body 12 to engage an annular groove 22 on the faucet 15 for locking the coupler assembly 10 to the faucet 15. These pockets 20 are sized so that the second inner portion of each of the locking balls 19 will extend far enough through the coupler body 12 to engage with the annular groove 22 on the faucet 15 but the ball 19 will not pass completely through the pocket 20.

As further shown in FIG. 1, the inlet end 13 of the coupler body 12 also has an inner annular groove 23 located axially inward from the locking balls 19 for receiving a circular rubber seal 24 to prevent fluid from escaping at the faucet 15.

Coaxial with the inlet end 13 of the coupler body 12 and intermediate the inlet and outlet is a pressure relief passageway 25 as shown in FIGS. 1, 2, 3 and 5. Mounted in this passageway 25 is an "O-ring" seal 26 and a pressure relief valve 29. The head portion 30 of the pressure relief valve 29 is biased toward the "O-ring" seal 26 by a valve spring 32 which surrounds the shaft 31 of the valve 29 and which is retained on the valve shaft 31 by two washers 33 and a locking ring 34.

The coupler body 12 is retained in the housing cavity by a projecting wall 35 in each half of the housing 11 which cooperates with a slot 36 in the coupler body 12 to prevent movement of the coupler body 12 in the housing 11. At the outlet end 14 of the coupler body 12 two spaced apart collars 39 are molded around the conduit. The smaller diameter 40 between these two collars 39 is captured by a matching arcuate cutout 41 in the adjacent wall 42 of each of the halves of the housing 11. The coupler body 12 is finally secured by two screws 43 which join the two halves of the housing 11 to the coupler body 12. Thus the combination of screws 43, projecting wall 35 and slot 36 and the collars 39 serve to contain the coupler body 12 securely within the housing 11 in all directions.

The outlet end 14 of the coupler body 12 has a plurality of annular serrations 44 molded onto its outer surface for gripping the inner diameter of the inlet hose 16 which is secured to the body 12 with a hose clamp 45. The inlet hose 16 extends from the coupler body 12 to the washing machine where a hose fitting 46 is connected to a water valve (not shown) for regulating water flow to the machine.

Figure 6:
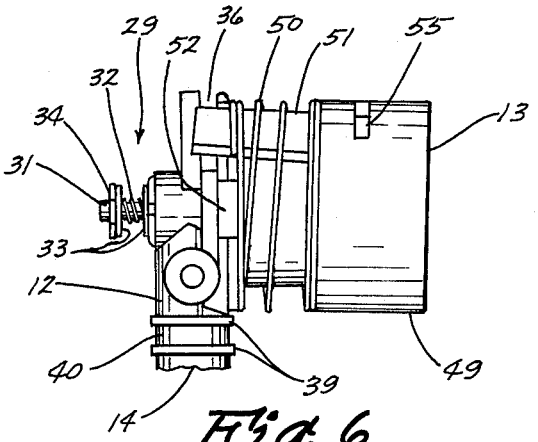
FIG. 6 is a fragmentary side view showing the process of assembly or disassembly of the coupler body and retaining ring.
Figure 7:
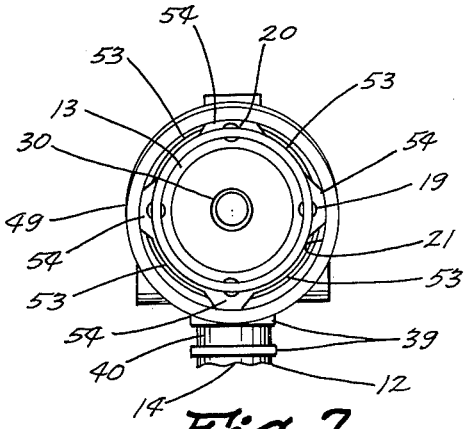
FIG. 7 is a fragmentary end view showing the process of assembly or disassembly of the coupler body and retaining ring.
Figure 8:
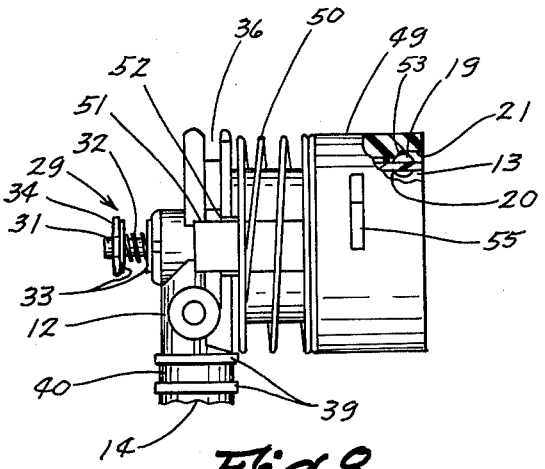
FIG. 8 is a view similar to FIG. 6 showing the coupler body and retaining ring assembled.
Figure 9:
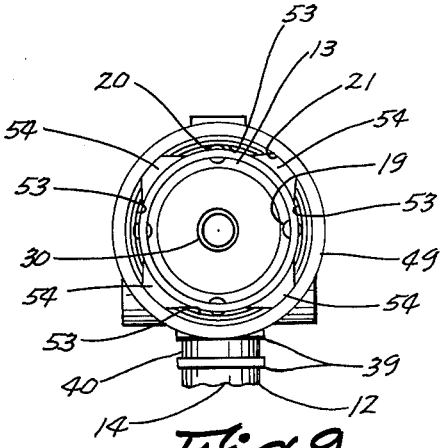
FIG. 9 is a view similar to FIG. 7 showing the coupler body and retaining ring assembled.

As best shown in FIGS. 6 through 9 a retaining ring 49 and a retaining spring 50 are assembled onto the coupler body 12 for cooperating with the locking balls 19 to retain the balls 19 between the body 12 and the ring 49. The retaining ring 49 has a plurality of angularly spaced radially inwardly extending segmental shoulders 53 around its inner periphery 21 which define a plurality of recesses 54, as shown in FIGS. 7 and 9, with one shoulder 53 and one recess 54 for each of the plurality of locking balls 19. As shown in FIGS. 7 and 9, the shoulders 53 are equally spaced around the inner periphery 21 of the retaining ring 49 with the recesses 54 equally disposed between the shoulders 53.

Figure 10:
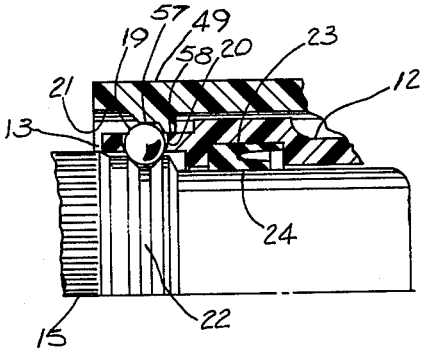
FIG. 10 is a partial fragmentary view of a shoulder portion of the retaining ring shown in an enlarged scale.

As further shown in FIGS. 8, 9 and 10 the inwardly extending segmental shoulders 53 have two levels. A first level 57 for engaging the locking balls 19 between the body 12 and the retaining ring 49 and for radially holding the locking balls 19 into engagement with the faucet groove 22 to maintain a coupled posture between the faucet 15 and the coupler body 12. A second level 58 is provided for limiting movement of the retaining ring 49 on the body 12 in an axial direction toward the inlet end 13. Engagement of the second level 58 with the locking balls 19 prevents the retaining ring 49 from coming off the coupler body 12.

The inner diameter 21 of the retaining ring 49 cooperates with the coupler body 12 to provide a third level of contact and to allow the locking balls 19 to move radially outward in the faucet receiving-releasing position. The locking balls 19 are prevented from completely moving out of their pockets 20 by the proximity of the third level or inner diameter 21 to the coupler body 12.

As shown in FIGS. 6 and 7, the retaining ring 49 is assembled onto the coupler body 12 in a first angular posture by aligning the recesses 54 with the locking balls 19 and axially moving the retaining ring 49 rearward onto the coupler body 12 with an axially extending leg portion 51 in a position as shown in FIG. 6. The retaining ring 49 is next rotated approximately 45° counterclockwise to a second angular position as in FIG. 8 where the leg portion 51 snaps into the detent slot 52 in the coupler body 12. In this orientation, the second level portion 58 of the inwardly extending shoulders 53 are behind the locking balls 19 as shown in the fragmentary portion of FIGS. 8 and 9 thus preventing the retaining ring 49 from moving axially off the coupler body 12 while the first level portion 57 of the shoulders 53 maintain the locking balls 19 between the retaining ring 49 and the coupler body 12 and engaged with faucet 15. When the retaining ring 49 is in this assembled orientation, it is concentric with the inlet portion 13 of the coupler body 12 and coaxial with the pressure relief valve 29.

Figure 4:
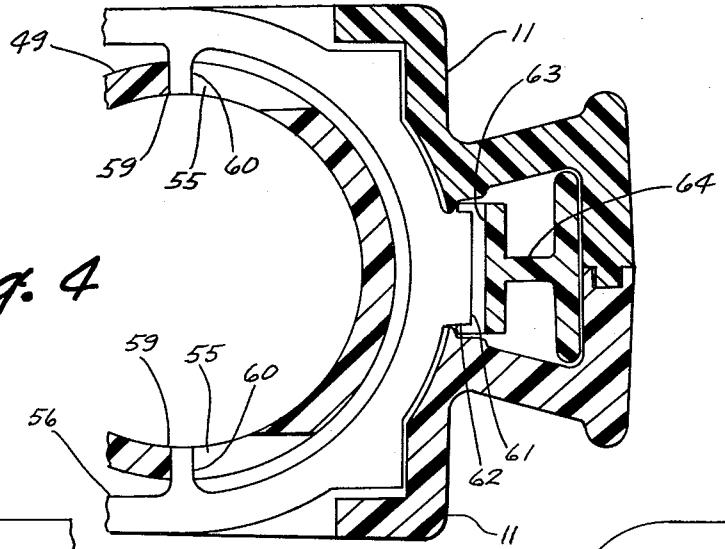
FIG. 4 is a view taken along lines 4—4 of FIG. 1 and shown in an enlarged scale.

Mounted on the retaining ring 49 in two support slots 55, as best shown in FIG. 4, is an operating lever or first operating means 56. This lever 56 pivots at two points. The first pivot 59 is where two lugs 60 contact the support slots 55 in the retaining ring 49. The second pivot 61 is where an end portion of the lever 62 engages a recess 63 in a slider or second operating means 64 as shown in FIGS. 1 and 4.

Figure 2:
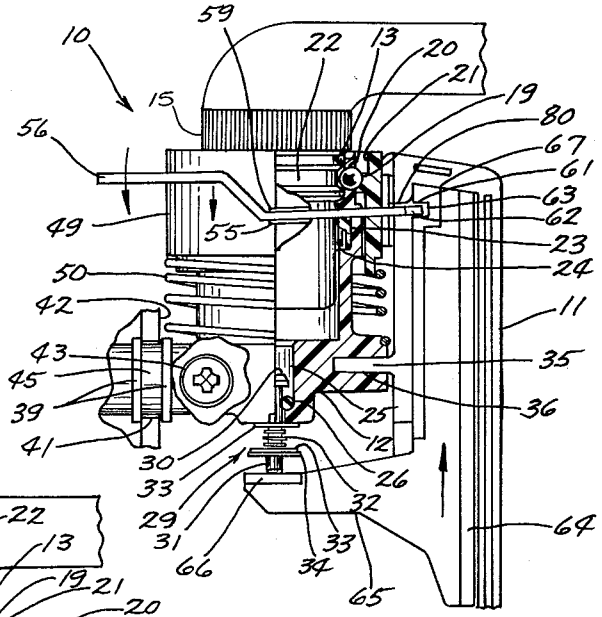
FIG. 2 is a fragmentary view showing the operating lever partially advanced.

The slider 64 is slideably supported by the housing 11 as shown in FIGS. 1 and 4 and is movable from a first position as in FIG. 1 to a second position as in FIG. 2 for engagement with and actuation of the pressure relief valve 29. The slider 64 has a generally "I" cross-section as shown in FIG. 4 and has a recess 63 at one end juxtaposed the end portion 62 of the lever 56 for receiving the end portion 62. The opposite end of the slider 64 has a laterally extending arm 65 with an enlarged pad for engaging the shaft portion 31 of the relief valve 29.

The retaining spring 50 and the valve spring 32 cooperate with the slider 64 and the operating lever 56 during movement of the operating lever 56 to define alternately fixed and moving pivots at the first pivot 59 and the second pivot 61 at different stages of movement. In a preferred embodiment of this invention the retaining spring 50 is approximately five times stronger than the valve spring 32. Because of this difference in strength, when the operating lever 56 is initially moved, the first pivot 59 is a fixed pivot and the second pivot 61 is a moving pivot. The slider 64 is free to move in the housing 11 and the pad 66 engages the shaft 31 of the relief valve 29 and opens the valve 29 against the weak bias of the valve spring 32. During this slider 64 movement, the retaining ring 49 is held stationary by the strong bias of the retaining spring 50. When the operating lever 56 has been advanced so that the slider engages a stop 67, the second pivot point 61 becomes a fixed pivot and the first pivot 59 becomes a moving pivot. Continued advancement of the operating lever 56 moves the retaining ring 49 axially against the bias of the retaining spring 50 to effect decoupling.

Also retained within the cavity of the housing 11 is a discharge conduit 69 having an inlet end 70 connected to the drain hose 72 of the washing machine and an outlet end 71 for discharging liquid into a sink. As shown in FIG. 1 the drain hose 72 is connected to a serrated portion of the conduit by a hose clamp 73. As in the coupler body 12, the discharge conduit 69 has two spaced apart collars 74 molded around its serrated end and is captured in a like manner by the adjacent walls 42 of the housing 11. The discharge conduit 69 is also fastened to the housing 11 by screws 75 in a manner similar to that of the coupler body 12. The discharge conduit 69 is positioned in the housing 11 so that the fluid discharge will impinge on a housing wall 76, as in FIG. 1, to fan out the discharge thus reducing splashing in the sink.

When the coupler body 12 and the discharge conduit 69 have been secured in the housing 11 by driving the screws 43 and 75, the coupler assembly 10 is completed by sliding the pistol grip portion 79 of the assembly 10 into place and driving the additional screws 81 to keep this grip portion 79 in place.

Figure 3:
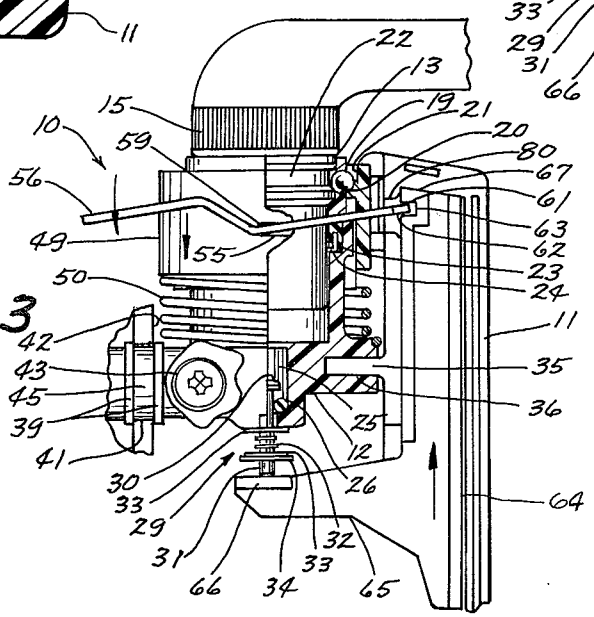
FIG. 3 is a view similar to FIG. 2 with the lever fully advanced.

Operation of the invention is shown in FIGS. 1, 2 and 3. FIG. 1 shows the coupler assembly 10 attached to a faucet 15 with the operating lever 56 and slider 64 in a neutral nonactuated position. Also in FIG. 1 the valve spring 32 is shown biasing the relief valve 29 to a closed or sealing position and the retaining spring 50 is biasing the retaining ring 49 to a faucet locking position. In FIG. 2, as downward axial pressure is placed on the operating lever 56, the lever 56 pivots simultaneously at the two pivot points 59 and 61. At this time, the first pivot point 59 at the retaining ring 49 is a fixed pivot while the second pivot 61 at the slider 64 is a moving pivot. This action moves the slider 64 toward an interior wall or stop 67 in the housing 11 and moves the arm portion 65 of the slider 64 and its associated enlarged pad 66 toward the relief valve 29. This movement overcomes the low biasing force of the valve spring 32, opens the valve 29 and depressurizes the coupler body 12 while the retaining ring 49 remains stationary.

in FIG. 3, the slider 64 is shown against the stop 67 in the housing 11 and the operating lever 56 is being moved further. When the slider 64 contacts the stop 67, the second pivot 61 at the slider 64 becomes a fixed pivot and the first pivot 59 at the ring 49 becomes a moving pivot. Additional movement of the operating lever 56 moves the retaining ring 49 axially against the bias of the retaining spring 50 to a faucet receiving-releasing position as shown in FIG. 3. In the faucet receiving-releasing position the locking balls 19 are free to move radially toward or away from the annular groove 22 in the faucet 15. Therefore it can be seen that this mechanism provides a sequential depressurization and then decoupling action for a coupler assembly 10 through a simple generally axial movement of the operating lever 56.

The feature of sequential depressurization and decoupling is also disclosed and is claimed in a copending application entitled "Faucet Coupler Assembly" filed on an even date with this application by John D. Goodlaxson and assigned to the assignee of the instant invention.

The operating lever or first operating means 56 and slider or second operating means 64 may be considered as comprising connecting means between the retaining ring 49 and valve 29. This connecting means is thus movable from a first neutral posture as in FIG. 1 to a second posture as in FIG. 2 for actuating the pressure relief valve 29 while the retaining ring 49 remains in the faucet locking position. The connecting means is further movable to a third posture as in FIG. 3 for overcoming the bias of the retaining spring 50 to axially move the retaining ring 49 to the faucet receiving-releasing position.

Figure 5:
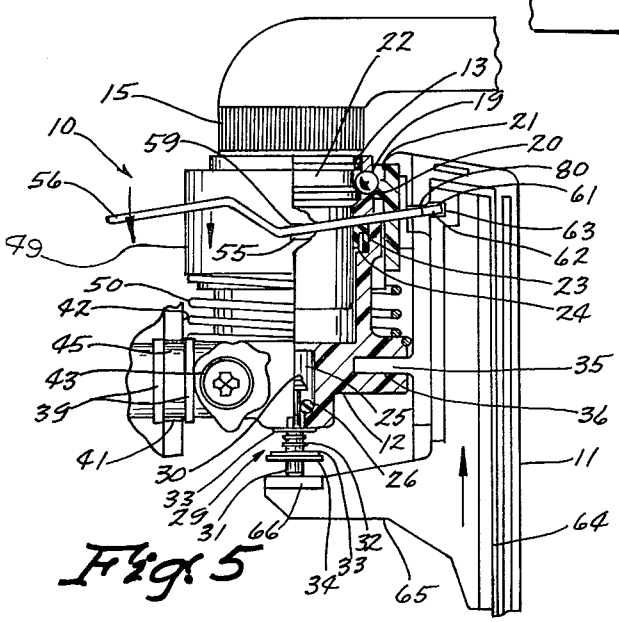
FIG. 5 is a view similar to FIG. 3 showing an alternate embodiment of the instant invention.

An additional embodiment is shown in FIG. 5. In this embodiment, the operation is the same as in FIGS. 2 and 3 except that the slider 64 does not travel to the stop 67. Instead the operating lever 56 pivots fixedly at the first pivot point 59 at the ring 49 and the second pivot 61 at the slider 64 moves until the operating lever 56 contacts a shoulder portion 80 of the housing 11. At this time the first pivot point 59 at the ring 49 becomes the moving pivot and decoupling takes place as before.

It is therefore seen that the instant invention provides clear and distinct advantages over faucet coupler assemblies shown in the prior art. The instant invention provides for a quarter turn assembly of the retaining ring 49 onto the coupler body 12 to retain the locking balls 19 between the body 12 and the ring 49 with a portion of the retaining ring 49 engaging the coupler body 12 to lock the assembly.

In the drawings and specification there has been set forth a preferred embodiment of the invention and although specific terms are employed these are used in a generic and descriptive sense only and not for purpose of limitation. Changes in form and proportion of parts, as well as the substitution of equivalents, are contemplated, as circumstances may suggest or render expedient, without departing from the spirit or scope of this invention as defined in the following claims.

I claim:

1. A coupler assembly for connecting a portable washing machine to a faucet disposed generally above a sink, the combination comprising: a coupler body defining a conduit having an inlet end for receiving said faucet and an outlet end connectable to said machine; means for connecting said inlet end to said faucet including a retaining ring and further including a plurality of angularly spaced locking means each including a portion extending radially outwardly from said coupler body and a portion extending through said body for engagement with said faucet, said retaining ring having angularly spaced radially inwardly extending segmental shoulders defining angular recesses therebetween, said recesses being generally alignable with said angularly spaced locking means in a first posture of said retaining ring to allow axial assembly of said retaining ring onto said coupler body, said retaining ring being rotatable to a second posture for at least partially aligning said shoulders with said locking means; means for maintaining said retaining ring in said second posture; and spring means for axially biasing said retaining ring to a faucet locking position, said retaining ring being axially retained on said coupler body by engagement of said locking means with said shoulders and being axially movable against said spring means while in said second posture from said faucet locking position to a faucet receiving-releasing position.

2. A coupler assembly as defined in claim 1 wherein said means for maintaining said retaining ring in said second posture includes firt means on said coupler body and second means on said retaining ring, said first and second means being engageable upon rotation of said retaining ring to said second posture.

3. A coupler assembly as defined in claim 2 wherein said first means for maintaining said retaining ring includes a detent slot on said coupler body and said second means includes a leg portion on said retaining ring for engaging with said detent slot and maintiaining said retaining ring in said second posture while permitting axial movement thereof.

4. A coupler assembly as defined in claim 1 wherein said locking means are radially movable relative to said retaining ring and said coupler body for engagement or disengagement with said faucet upon said faucet upon said axial movement of said retaining ring.

5. A coupler assembly as defined in claim 1 wherein said locking means comprise a plurality of detached and separate angularly spaced members.

6. A coupler assembly for connecting a portable washing machine to a faucet disposed generally above a sink, the combination comprising: a coupler body defining a conduit having an inlet end for receiving said faucet and an outlet end connectable to said machine; means for connecting said inlet end to said faucet including a retaining ring and further including a plurality of angularly spaced locking means each including a first portion disposed between the inner diameter of said retaining ring and said inlet end of said body and a second portion extending through said body for engagement with said faucet, and retaining ring having angularly spaced radially inwardly extending segmental shoulders around the inner periphery defining angular recesses therebetween, said recesses being alignable with said locking means in a first angular posture of said retaining ring to allow rearward axial movement of said retaining ring onto said coupler body, said retaining ring being rotatable to a second angular posture with said shoulders being at least partially aligned with said locking means; means for maintaining said retaining ring in said second angular posture including a first member on said coupler body and a second member on said retaining ring, said first and second members being engageable upon rotation of said retaining ring to said second angular posture; and spring means for axially biasing said retaining ring to a faucet locking position, said retaining ring being axially retained on said coupler body by engagement of said locking means with said shoulders and being axially movable while in said second posture from said faucet locking position to a faucet receiving-releasing position.

7. A coupler assembly as defined in claim 6 wherein said angularly spaced radially inwardly extending segmental shoulders are equally spaced around the inner periphery of said retaining ring.

8. A coupler assembly as defined in claim 6 wherein said retaining ring rotates through substantially 45° when rotating from said first angular posture to said second angular posture.

9. A coupler assembly as defined in claim 6 wherein said radially inwardly extending segmental shoulders extend inward at two levels, a first level for limiting radial movement of said locking means and a second level for limiting axial movement of said retaining ring.

10. A coupler assembly for connecting a portable washing machine to a faucet disposed generally above a sink, the combination comprising: a coupler body defining a conduit having an inlet end for receiving said faucet and an outlet end connectable to said machine; means for connecting said inlet end to said faucet including a retaining ring and further including a plurality of angularly spaced locking means each including a first portion disposed between the inner diameter of said retaining ring and said inlet end of said body and a second portion extending through said body for engagement with said faucet, said retaining ring having angularly spaced radially inwardly extending segmental shoulders around the inner periphery with a first level for engaging said locking means with said faucet and a second level for preventing axial movement of said ring, said shoulders defining angular recesses therebetween, said recesses being alignable with said locking means in a first angular posture of said retaining ring to allow rearward axial movement of said retaining ring onto said coupler body, said retaining ring being rotatable through a predetermined angle to a second angular posture with said second level of said shoulders being at least partially aligned with said locking means; detent means for maintaining said retaining ring in said second angular posture including a detent slot axially spaced from said inlet end of said coupler body and an axially extending leg on said retaining ring, said detent slot and said axially extending leg being engageable upon rotation of said retaining ring to said second angular posture; and spring means for axially biasing said retaining ring to a faucet locking position, said retaining ring being axially retained on said coupler body by engagement of said locking means with said shoulders and being axially movable while in said second posture from said faucet locking position to a faucet receiving-releasing position.

11. A coupler assembly as defined in claim 10 wherein said locking means are retained in angularly spaced pockets open at both ends and proportioned to capture said locking means.

12. A coupler assembly as defined in claim 10 wherein said locking means are individually radially movable in an inward and an outward direction for locking and receiving or releasing said faucet.

* * * * *